US012429230B2

(12) United States Patent
Kim et al.

(10) Patent No.: US 12,429,230 B2
(45) Date of Patent: Sep. 30, 2025

(54) DRAWER DEVICE AND APPLIANCE HAVING THE SAME

(71) Applicant: SAMSUNG ELECTRONICS CO LTD., LTD., Suwon-si (KR)

(72) Inventors: Seokang Kim, Suwon-si (KR); Junesang Mok, Suwon-si (KR); Youngmin Cheong, Suwon-si (KR)

(73) Assignee: SAMSUNG ELECTRONICS CO., LTD., Gyeonggi-Do (KR)

( * ) Notice: Subject to any disclaimer, the term of this patent is extended or adjusted under 35 U.S.C. 154(b) by 508 days.

(21) Appl. No.: 17/894,679

(22) Filed: Aug. 24, 2022

(65) Prior Publication Data

US 2022/0404029 A1 Dec. 22, 2022

Related U.S. Application Data

(63) Continuation of application No. PCT/KR2020/018894, filed on Dec. 22, 2020.

(30) Foreign Application Priority Data

Mar. 31, 2020 (KR) ..... 10-2020-0038900

(51) Int. Cl.
*F24C 15/18* (2006.01)
*A47B 77/08* (2006.01)
(Continued)

(52) U.S. Cl.
CPC ..... *F24C 15/18* (2013.01); *A47B 77/08* (2013.01); *A47B 77/16* (2013.01); *F24C 15/08* (2013.01)

(58) Field of Classification Search
CPC ..... F24C 15/18; F24C 7/067
See application file for complete search history.

(56) References Cited

U.S. PATENT DOCUMENTS 7,619,182 B2 11/2009 Morrow et al.
2007/0158331 A1* 7/2007 Morrow ..... A47B 77/08 219/412

(Continued)

FOREIGN PATENT DOCUMENTS

EP 2614309 B1 * 11/2016 ..... F24C 15/18
KR 200390573 Y1 * 7/2005 ..... F24C 7/067

(Continued)

OTHER PUBLICATIONS

Machine Translation of KR 200390573 (Year: 2005).*

(Continued)

*Primary Examiner* — Steven B McAllister
*Assistant Examiner* — Amy E Carter
(74) *Attorney, Agent, or Firm* — CANTOR COLBURN LLP

(57) ABSTRACT

An oven includes a main body providing a first heating space of the oven, and a drawer device which is below the first heating space. The drawer device includes a drawer casing providing an opening at which the drawer casing is open to outside the drawer device at a front of the oven, a drawer insertable into or removable out of the drawer casing, through the opening, a drawer heater installed in the drawer casing, and a drawer heater cover detachably coupled with the drawer casing at the front of the oven and rotatably coupled with the drawer casing at a rear of the oven which is opposite to the front of the oven, the drawer heater cover being moveable relative to the drawer heater.

13 Claims, 16 Drawing Sheets

(51) Int. Cl.
*A47B 77/16* (2006.01)
*F24C 15/08* (2006.01)

(56) References Cited

U.S. PATENT DOCUMENTS

| | | | | |
|---|---|---|---|---|
| 2013/0020308 | A1* | 1/2013 | Cha | F24C 15/18 219/394 |
| 2016/0091209 | A1* | 3/2016 | Jung | F24C 15/024 219/394 |

FOREIGN PATENT DOCUMENTS

| | | | | |
|---|---|---|---|---|
| KR | 10-0785130 | B1 | 12/2007 | |
| KR | 20110078910 | A * | 7/2011 | F24C 7/02 |
| KR | 1020130011487 | A | 1/2013 | |
| KR | 10-1276498 | B1 | 6/2013 | |
| KR | 10-1634809 | B1 | 6/2016 | |
| KR | 1020190117246 | A | 10/2019 | |
| WO | 2021201381 | A1 | 10/2021 | |

OTHER PUBLICATIONS

Machine Translation of KR 20110078910 (Year: 2011).*
Korean Office Action for Korean Patent Application No. 10-2020-0038900 dated Aug. 20, 2024.

* cited by examiner

DRAWER DEVICE AND APPLIANCE HAVING THE SAME

CROSS-REFERENCE TO RELATED APPLICATIONS

This application is a PCT-Bypass Continuation application of International Application No. PCT/KR2020/018894 designating the United States, filed on Dec. 22, 2020, in the Korean Intellectual Property Receiving Office, which claims priority to Korean Patent Application No. 10-2020-0038900, filed on Mar. 31, 2020 in the Korean Intellectual Property Office, and all the benefits accruing therefrom under 35 U.S.C. § 119, the disclosures of which are incorporated by reference herein in their entireties.

BACKGROUND

1. Field

The present disclosure relates to an appliance, and more particularly, to a drawer device and a cooking device including the same.

2. Discussion of Related Art

An oven is an appliance for cooking (e.g., a cooking appliance and includes a cooking room (or cooking space), a heater for applying heat to the cooking room, and a circulator for circulating heat generated by the heater inside the cooking room to heat an object such as for cooking food.

The oven is an appliance for cooking food by sealing and heating the food. Ovens are classified into an electric type, a gas type, and an electronic type according to heat sources.

Electric ovens use an electric heater as a heat source, and gas ovens and microwaves use heat generated by a gas and friction forces of water molecules caused by high frequencies, respectively, as heat sources.

In general, an electric oven includes a drawer device for warming food or a dish containing food. The drawer device is positioned in a lower part of the oven.

SUMMARY

The drawer device of a cooking appliance such as an oven, includes a drawer in which food or a container containing food is accommodated, a drawer casing from which the drawer is slidingly disposed in a front-rear direction of the appliance to be withdrawn out of and retracted into the appliance, a heater for heating the food or container disposed in the drawer, etc. The heater is positioned in an upper or lower side of the drawer casing (e.g., an upper-lower direction crossing the front-rear direction).

In the drawer device, a separate heater cover (bracket) for preventing injury that may be caused by the heater is installed. The heater cover is fixed to the drawer casing by using a fixing member such as screws, which deteriorates workability of the cooking appliance.

Also, a communication terminal, etc. for services such as software update may be installed in the drawer device. In this case, accessing the communication terminal by service engineers may be difficult, which makes repairs, etc. to the oven difficult, resulting in deterioration of service efficiency.

An embodiment of the disclosure provides a drawer device with an improved structure, and an oven including the same.

An embodiment of the disclosure provides an oven capable of improving installability and service efficiency, by improving an assembly structure of a heater cover of a drawer device.

An embodiment of the disclosure provides an oven capable of enhancing workability by improving an installation location of a communication terminal.

According to an embodiment of the present disclosure, an oven includes a main body providing a cooking room, and a drawer device provided below the main body. The drawer device includes a drawer casing in which an opening is formed (or provided), a drawer being insertable into or removable from the drawer casing through the opening, a drawer heater configured to heat an inside space of the drawer and installed in the drawer casing, and a drawer heater cover covering the drawer heater, and including a first coupler rotatably coupled with the drawer casing and a second coupler detachably coupled with the drawer casing.

Also, the drawer heater cover may expose the drawer heater by rotating from a first position at which the drawer heater cover covers the drawer heater, to a second position at which the drawer heater cover is located slopingly (or inclined) with respect to the first position.

Also, in the drawer heater cover located at the first position, the first coupler and the second coupler may be fixed to the drawer casing.

Also, in the drawer heater cover located at the second position, the first coupler may be fixed to the drawer casing and the second coupler may be separated from the drawer casing.

Also, the oven may further include a heater positioned below the cooking room in such a way as to be adjacent to an upper surface of the drawer casing and heat the cooking room, where the drawer heater cover may be positioned between the upper surface of the drawer casing and the drawer to prevent heat of the heater from being transferred to the inside space of the drawer.

Also, the drawer heater cover may include a plurality of holes formed to transfer heat of the drawer heater, to the inside space of the drawer.

Also, the drawer casing may further include a terminal installing portion in which a communication terminal is installed. The terminal installing portion may be positioned in a front portion of the drawer casing such that an access to the terminal installing portion is possible through the opening.

Also, the terminal installing portion may be formed by depressing at least one portion of a side surface of the drawer casing.

Also, the drawer casing may further include a rail along which the drawer is movable, and the terminal installing portion may be positioned at an upper location than the rail.

A drawer device for a heating appliance includes a drawer casing in which an opening is formed, a drawer insertable into and removable from the drawer casing, through the opening, a drawer heater installed in the drawer casing and configured to heat an inside space of the drawer, and a heater cover covering the drawer heater, where the drawer heater cover includes a first coupler rotatably coupled with the drawer casing, and a second coupler detachably coupled with the drawer casing through the opening.

Also, the drawer heater cover may be located at a first position at which the drawer heater cover covers the heater, or a second position at which the drawer heater cover is located slopingly with respect to the first position to expose the heater.

Also, in the drawer heater cover located at the first position, the first coupler and the second coupler may be fixed to the drawer casing.

Also, in the drawer heater cover located at the second position, the first coupler may be fixed to the drawer casing and the second coupler may be separated from the drawer casing.

Also, the drawer heater cover may include a plurality of holes formed to transfer heat of the drawer heater to the inside space of the drawer.

An oven includes a main body providing a cooking room, a cooktop installed on an upper portion of the main body, a drawer casing provided in a lower portion of the main body, where an opening is formed in the drawer casing, a drawer being inserted into or taken out of the drawer casing through the opening, and a terminal installing portion in which a terminal is installed and which is positioned in a front portion of the drawer casing, where an access to the terminal installing portion is possible through the opening.

Also, the oven may further include a drawer heater installed in the drawer casing and configured to heat an inside space of the drawer, and a drawer heater cover covering the drawer heater, where one end of the drawer heater cover is rotatably connected with the drawer casing and the other end of the drawer heater cover is detachably coupled with the drawer casing, where an access to the other end is possible through the opening.

Also, the drawer heater cover may include a first coupler rotatably coupled with the drawer casing and a second coupler detachably coupled with the drawer casing through the opening.

Also, the oven may further include a heater positioned below the cooking room in such a way as to be adjacent to an upper surface of the drawer casing to heat the cooking room, where the drawer heater cover may be positioned between the upper surface of the drawer casing and the drawer to prevent heat of the heater from being transferred to inside of the drawer.

Also, the terminal installing portion may be formed by depressing at least one portion of a side surface of the drawer casing.

Also, the drawer casing may further include a rail device along which the drawer is movable, and the terminal installing portion may be positioned at an upper location than the rail device.

BRIEF DESCRIPTION OF THE DRAWINGS

The above and other objects, features and advantages of the present disclosure will become more apparent to those of ordinary skill in the art by describing in detail embodiments thereof with reference to the accompanying drawings, in which.

DETAILED DESCRIPTION

Figure 1:
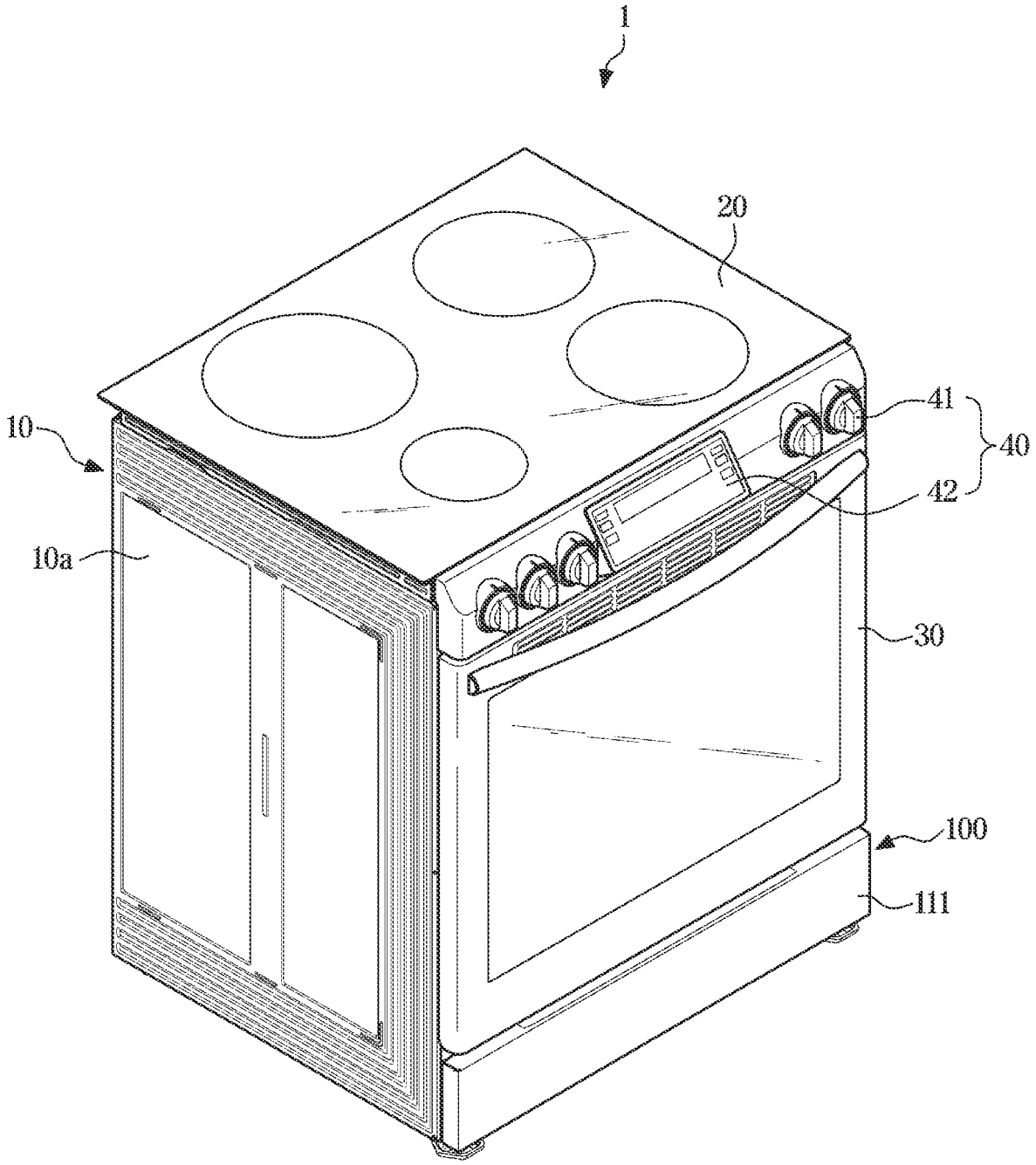
FIG. 1 is a perspective view of an oven according to an embodiment of the disclosure.

Configurations illustrated in the embodiments and the drawings described in the present specification are only embodiments of the present disclosure, and thus it is to be understood that various modified examples, which may replace the embodiments and the drawings described in the present specification, are possible when filing the present application.

Also, like reference numerals or symbols denoted in the drawings of the present specification represent members or components that perform the substantially same functions.

Also, the terms used in the present specification are used to describe the embodiments, not for the purpose of limiting and/or restricting the disclosure. It is to be understood that the singular forms "a," "an," and "the" include plural referents unless the context clearly dictates otherwise. For example, "an element" has the same meaning as "at least one element," unless the context clearly indicates otherwise. As used herein, a reference number may indicate a singular element or a plurality of the element. For example, a reference number labeling a singular form of an element within the drawing figures may be used to reference a plurality of the singular element.

It will be understood that when the terms "includes," "comprises," "including," and/or "comprising," when used in this specification, specify the presence of stated features, figures, steps, operations, components, members, or combinations thereof, but do not preclude the presence or addition of one or more other features, figures, steps, operations, components, members, or combinations thereof.

Also, it will be understood that, although the terms including ordinal numbers, such as "first", "second", etc., may be used herein to describe various components, these components should not be limited by these terms. These terms are only used to distinguish one component from another. For example, a first component could be termed a second component, and, similarly, a second component could be termed a first component, without departing from the scope of the present disclosure.

"At least one" is not to be construed as limiting "a" or "an." "Or" means "and/or." As used herein, the term "and/or" includes any and all combinations of one or more of associated listed items.

In the following description, the terms "front", "rear", "left", and "right" are defined based on the drawings, and the shapes and positions of the components are not limited by the terms.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

Hereinafter, embodiments of the disclosure will be described in detail with reference to the accompanying drawings.

A front surface and a front direction used below indicate a front surface of an appliance such as an oven 1 shown in FIG. 1 and a direction toward a front direction of the oven, respectively, and a rear direction indicates a direction toward a rear direction of the oven 1. A front-rear direction of the appliance may indicate a direction along which a component may be withdrawn out of and retracted into the appliance. An upper-lower direction may cross the front-rear direction.

Although a drawer device according to an embodiment of the disclosure is described as that installed in an oven 1, the drawer device may be applied to a home appliance including a drawer that is withdrawable from and retractable into a drawer casing. Although the drawer device according to an embodiment of the disclosure is described as that installed in an oven 1, the drawer device may be applied to a home appliance including a heater (e.g., a heating appliance).

Figure 2:
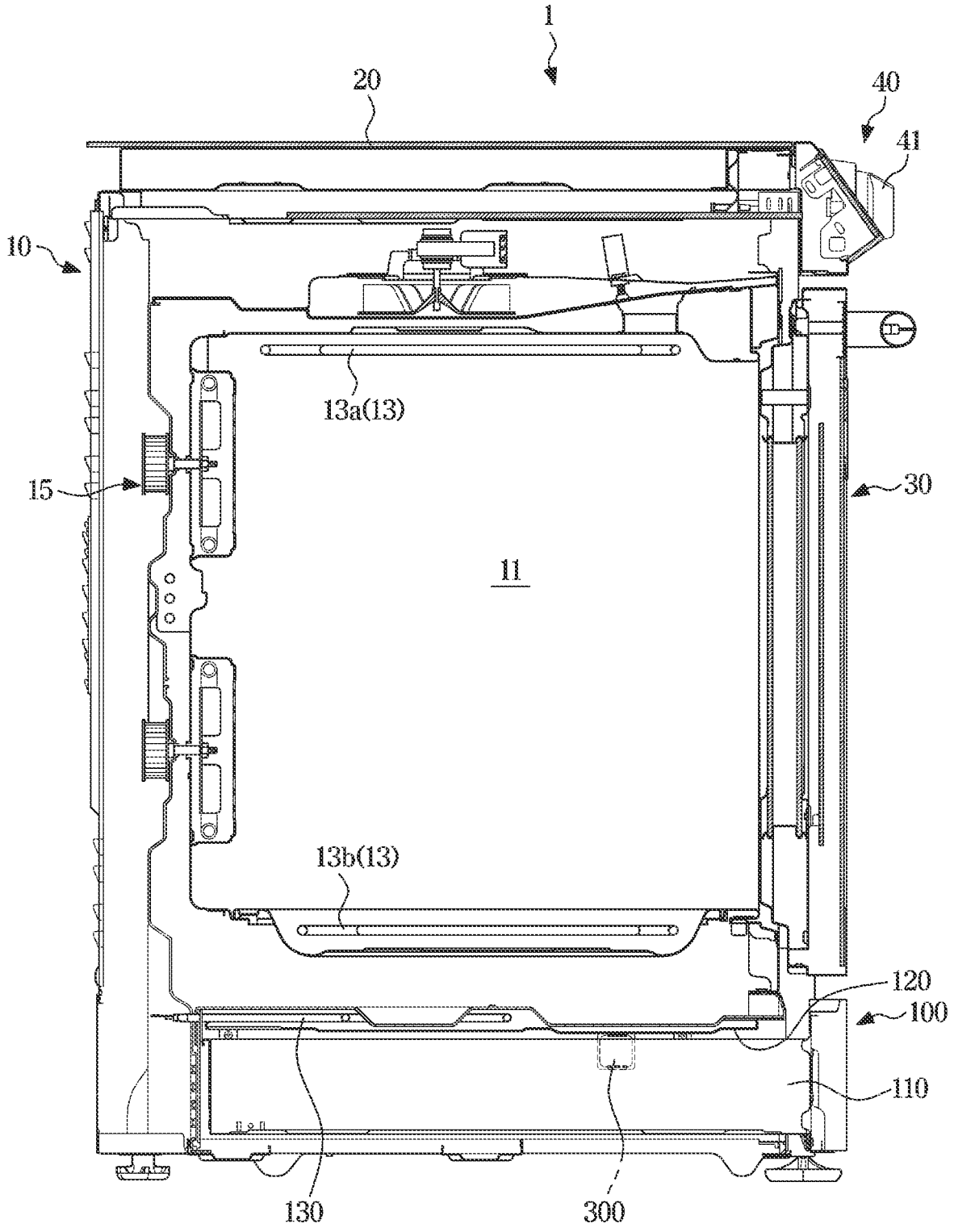
FIG. 2 is a cross-sectional view of an oven according to an embodiment of the disclosure.
Figure 3:
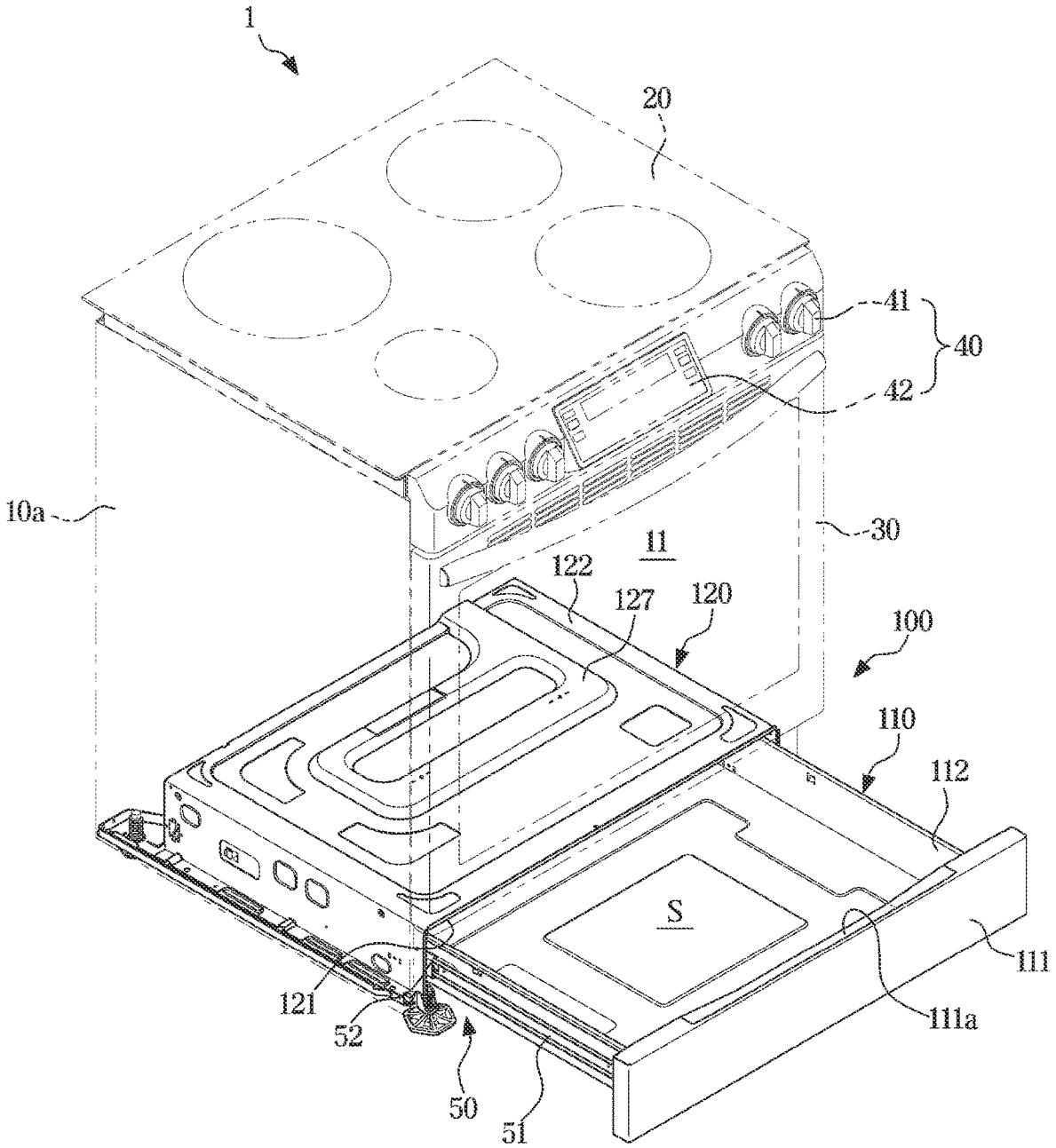
FIG. 3 shows a drawer device of an oven according to an embodiment of the disclosure.

FIG. 1 is a perspective view of an oven according to an embodiment of the disclosure, FIG. 2 is a sectional view of an oven according to an embodiment of the disclosure, and FIG. 3 shows a drawer device of an oven according to an embodiment of the disclosure. An upper-lower direction of the appliance in FIGS. 1 to 3 may be taken along a vertical direction of the views.

As shown in FIGS. 1 to 3, an oven 1 may include a main body 10 forming an outer appearance and forming a cooking room 11 therein (e.g., a first heating space), and a cooktop 20 provided at a top of the oven 1 and configured to heat a container put (or accommodated) thereon and containing a cooking material (e.g., an object to be cooked or heated).

The main body 10 of the oven 1 may include an inner case 10*a* forming the cooking room 11, and an outer case (not shown) which is coupled with an outer side of the inner case 10*a* and forms (or provides) the outer appearance of the oven 1. In the cooking room 11, a heater 13 for heating food may be provided, and the heater 13 may be an electric heater including an electrical resistor, although not limited thereto. The heater 13 may be a gas heater that generates heat by burning a gas. Accordingly, the oven 1 may include an electric oven and a gas oven. Each of the inner case 10*a* and the outer case may be in a shape of a box of which a front side opens (e.g., is openable and closeable), although not limited thereto. The oven 1 may be installed as a built-in type in a system kitchen.

In an upper area of the cooking room 11 or an internal top of the cooking room 11, an upper heater 13*a* for heating inside of the cooking room 11 may be provided. Also, in a lower area of the cooking room 11 or an internal bottom of the cooking room 11, a lower heater 13*b* for heating the cooking room 11 may be provided. The heater 13 may include the upper heater 13*a* and the lower heater 13*b* (e.g., the upper heater 13*a* together with the lower heater 13*b*). In the embodiment of the disclosure, an example in which the upper and lower heaters 13*a* and 13*b* are respectively positioned in the upper and lower areas of the cooking room 11 is shown, although a concept of the disclosure is not limited thereto.

On an internal rear surface or a rear portion of the cooking room 11, a circulating fan 15 may be provided to convect heated air to uniformly heat a cooking material inside the cooking room 11.

The oven 1 may include a door 30 provided on a front surface of the main body 10 to open or close the cooking room 11 relative to outside the oven 1. The door 30 may be made of a transparent material such as glass to enable a user to check the cooking room 11 and a cooking process of a cooking material inside the cooking room 11 from outside. With reference to FIG. 3, a front-rear direction of the appliance may be taken from the right side (e.g., corresponding to the door 30) to the left side (e.g., corresponding to the circulating fan 15) of the view.

On a front upper surface of the main body 10, a control panel 40 having a controller 41 for receiving an operation command from a user and a display 42 for displaying operation information of the oven 1 may be provided.

The controller 41 of the control panel 40 may enable an external input such as a control signal from outside the oven 1 (e.g., from a user), for operating the cooktop 20, the oven 1, and a drawer device 100. The controller 41 may include a plurality of switches to enable a user to himself/herself input a signal to operate the oven. The controller 41 may include any other type of configuration, such as a touch screen or a button, instead of a switch type. An upper-lower direction of the appliance in FIGS. 1 to 3 may be taken from the top side (e.g., corresponding to the cooktop 20 and/or the control panel 40) to the bottom side (e.g., corresponding to the drawer device 100).

The display 42 of the control panel 40 may provide operation information of the cooktop 20, the oven 1, and the drawer device 100, food recipe information, etc.

The display 42 displaying various operation information of the oven 1 and enabling a user to input an operation command may be provided on the front upper surface of the main body 10.

The display 42 may include a liquid crystal display (LCD), and the LCD may convert electrical information into visual information by using a change of liquid crystal transmittance according to an applied voltage and display the visual information.

In a lower portion of the oven 1, that is, in a lower portion of the main body 10, the drawer device 100 may be provided. The drawer device 100 (e.g., a heated drawer device) may be provided to warm a cooking material or a dish for containing a cooking material.

The drawer device 100 may include a drawer casing 120, a drawer 110, a drawer heater 130, and a drawer heater cover 200 (see FIG. 3).

The drawer device 100 may include the drawer 110 that may be taken out the oven 1 in (or toward) a front direction or inserted into the oven 1 in (or toward) a rear direction.

The drawer 110 may define a space where a cooking material or a dish for containing a cooking material is substantially accommodated, and the drawer 110 may be inserted into or taken out of the oven 1 (e.g., insertable into or removable out of the oven 1).

The drawer 110 may include a drawer body 112, and a front plate 111 which is provided in (or at) a front portion of the drawer body 112. The front plate 111 may be installed at the front portion of the drawer body 112.

The front plate 111 of the drawer 110 may be made of or include the same material as the main body 10 of the oven 1 or the door 30, to give a sense of unity with respect to the outer appearance of the oven 1.

In the front plate 111 of the drawer 110, a drawer handle 111*a* may be provided. The drawer handle 111*a* may be gripped by a user (e.g., grippable by a user) to move the drawer 110 into/out of the oven 1.

The drawer body 112 may be in a shape of a hexahedron of which an upper side is open to outside the drawer 110, such as to form an inside space S where a cooking material or a dish for containing a cooking material is accommodated (e.g., a second heating space).

A rail device 50 along which the drawer 110 is moveable may be provided on both outer sides of the drawer body 112 which oppose each other along a left-right direction of the oven 1 which crosses each of the front-rear and upper-lower directions. A first rail 51 of the rail device 50 may be provided on the both opposing sides of the drawer body 112. The first rail 51 may enable the drawer body 112 to slide in the front/rear direction of the oven 1.

In the drawer casing 120, a second rail 52 corresponding to the first rail 51 of the drawer body 112 may be installed.

Figure 4:
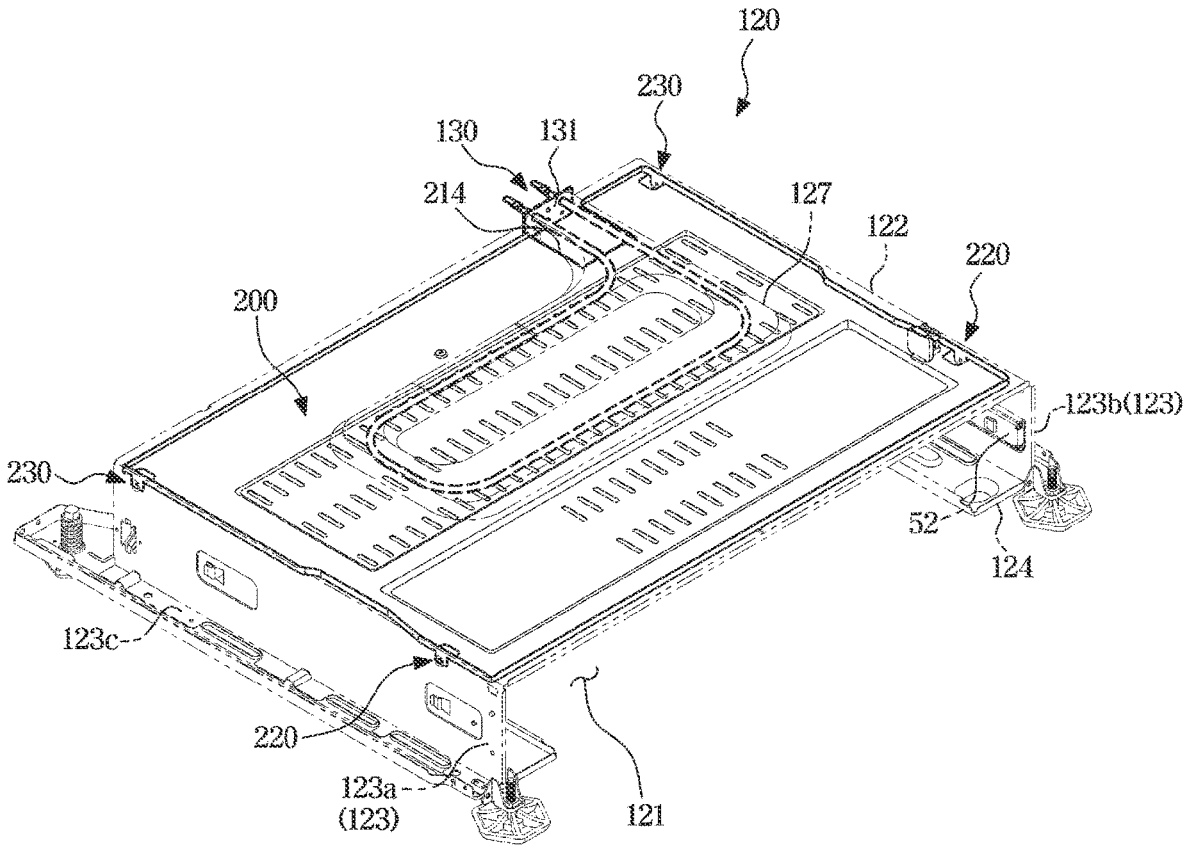
FIG. 4 is a perspective view showing a drawer casing of a drawer device according to an embodiment of the disclosure.
Figure 5:
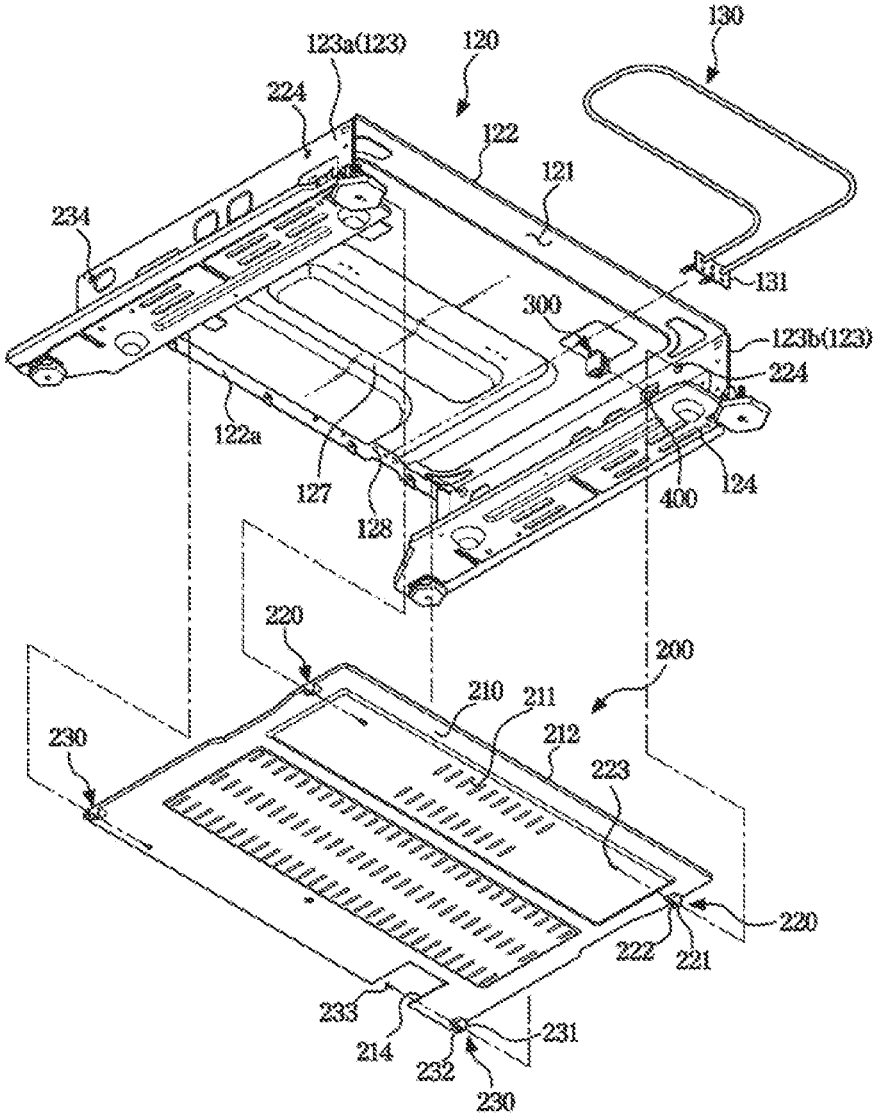
FIG. 5 is an exploded perspective view showing a drawer casing according to an embodiment of the disclosure.

FIG. 4 is a perspective view showing a drawer casing 120 of a drawer device 100 according to an embodiment of the disclosure, and FIG. 5 is an exploded perspective view showing a drawer casing 120 according to an embodiment of the disclosure.

As shown in FIGS. 4 and 5, the drawer device 100 may include the drawer casing 120, and the drawer 110 that is removed from the drawer casing 120.

The drawer device 100 may include the drawer heater 130 and the drawer heater cover 200 that are installed on the drawer casing 120.

The drawer casing 120 may be positioned inside the main body 10 of the oven 1. The drawer 110 may be inserted into the oven 1 in the rear direction or taken out of the oven 1 in the front direction, through an opening 121 of the drawer casing 120. The drawer casing 120 may be open at the opening 121 in both a lower direction toward the drawer 110 and in a front direction.

The drawer casing 120 may include a top panel 122 being flat and forming an upper surface of the drawer casing 120, and side panels 123 extending downward from both edges of the top panel 122 and forming opposing sides of the drawer casing 120. The drawer casing 120 may include the upper surface which is adjacent to the cooking room 11 as the first heating space. According to an embodiment of the disclosure, an example in which a drawer casing 120 is configured only with a top panel and side panels is shown, although a concept of the disclosure is not limited thereto. For example, the drawer casing 120 may be in a shape of a box of having each of top and bottom panels together with side panels 123 and for which a front side opens such that a drawer 110 is insertable into the drawer casing 120 in the rear direction or removable from the drawer casing 120 in the front direction. The drawer casing 120 may support a weight of remaining portions of the oven 1, such as those portions above the drawer casing 120 in the upper-lower direction.

The drawer heater 130 may be installed in the drawer casing 120. The drawer heater 130 may be installed on the top panel 122 of the drawer casing 120.

The drawer heater 130 may heat the inside space S of the drawer 110 up to preset temperature. As such, a cooking material accommodated in the drawer 110 or a dish for containing a cooking material may be warmed up or kept warm by heat emitted from the drawer heater 130. That is, the drawer 110 which is inserted into the drawer casing 120 may dispose the inside space S facing the drawer heater 130, such that heat from the drawer heater 130 is provided to the inside space S.

The drawer heater 130 may be positioned inside the drawer casing 120.

The drawer casing 120 may include a heater installing portion 127 formed by a protruded portion of the top panel 122 which protrudes from a top surface of the top panel 122 and upward in a direction away from the drawer 110. The drawer heater 130 may be installed on the heater installing portion 127 of the drawer casing 120.

The drawer heater 130 may be positioned in the heater installing portion 127. In the heater installing portion 127, a heater through hole 128 may be formed to pass a portion of a rear end of the drawer heater 130 through. The heater through hole 128 may be formed in at least one portion of the top panel 122. One or more end of the drawer heater 130 may extend through the heater through hole 128.

The drawer heater 130 may include a drawer heater bracket 131. The drawer heater bracket 131 may support the drawer heater 130 with respect to the drawer casing 120 such that the portion of the rear end of the drawer heater 130 passes through the heater through hole 128.

The top panel 122 and the side panels 123 of the drawer casing 120 may be integrated together into one body. A rear edge of the top panel 122 may include a top panel flange 122*a* bent downward in a direction away from the top surface of the top panel 122. The heater through hole 128 may be formed in the top panel flange 122*a*. The drawer heater bracket 131 may be supported by the top panel flange 122*a*. The drawer heater bracket 131 may be supported on an inner surface of the top panel flange 122*a* such that the drawer heater 130 moves in the front direction of the oven 1 and is attachable to or detachable from the drawer casing 120.

The side panels 123 of the drawer casing 120 may include a first side 123*a* positioned at one edge of the top panel 122 (e.g., a first edge) and a second side 123*b* positioned at the other edge of the top panel 122 (e.g., a second edge which is opposite to the first edge).

The first side 123*a* and the second side 123*b* may extend vertically from the top surface of the top panel 122. The first side 123*a* may face the second side 123*b* along a left-right direction of the drawer casing 120.

The drawer casing 120 may include a base 124 forming a portion of a bottom of the drawer casing 120. The base 124 may be formed at a lower portion of the side panel 123. The base 124 may be formed in a shape of a bar having a preset length and a preset width. The base 124 may be formed at a lower end of each of the first side 123*a* and the second side 123*b*.

At least one portion of the lower end of each of the first side 123*a* and the second side 123*b* may include a side panel flange 123*c* formed by being bent outward. The base 124 may be coupled with the side panel flange 123*c* of each of the first side 123*a* and the second side 123*b*.

Figure 7:
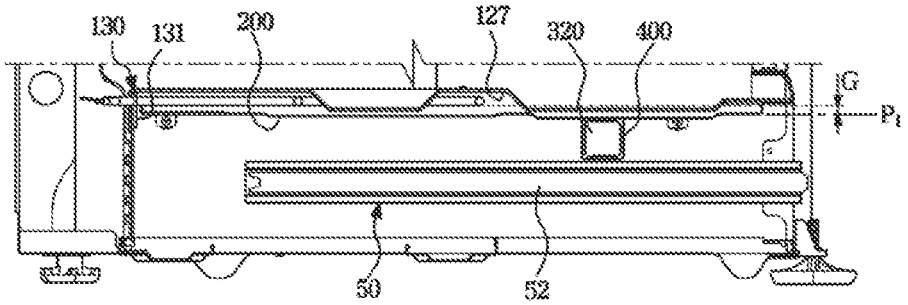
FIG. 7 is a side cross-sectional view of a drawer device according to an embodiment of the disclosure, showing a drawer heater cover installed in a drawer casing.

The second rail 52 of the rail device 50 may be installed on an inner surface of each of the first side 123*a* and the second side 123*b* (see FIG. 7). The second rail 52 may be installed at a location corresponding to the first rail 51 of the drawer 110.

The drawer device 100 may include the drawer heater cover 200 covering the drawer heater 130. The drawer heater cover 200 may cover the drawer heater 130 positioned on an inner top surface of the drawer casing 120.

The drawer heater cover 200 may prevent a user's injury that may occur by the drawer heater 130 positioned on the inner top surface of the drawer casing 120.

The drawer heater cover 200 may prevent heat generated by the heater 13 for heating the cooking room 11 from being transferred to inside of the drawer 110.

The drawer heater cover 200 may prevent heat generated from the lower heater 13*b* positioned below the cooking room 11 and adjacent to the upper surface of the drawer casing 120 to heat the cooking room 11, from being transferred to the drawer casing 120 of the drawer device 100 and to the inside of the drawer 110. The drawer heater cover 200 may prevent a user's injury that may occur upon transferring of heat generated from the cooking room 11 to the inside of the drawer 110. The drawer heater cover 200 may be positioned between the upper surface of the drawer casing 120 and the drawer 110. The drawer heater cover 200 may dissipate heat generated by the heater 13 and transferred from the cooking room 11. That is, the drawer heater cover 200 may function as a heat dissipation member.

The drawer heater cover 200 may be formed as a plate having a preset area, where the area is a planar area defined by a product of dimensions along the front-rear direction and the left-right direction. The drawer heater cover 200 may cover a lower portion of the drawer heater 130.

The drawer heater cover 200 may include a cover body 210 formed in a shape of a plate. In the cover body 210, a plurality of holes 211 may be formed or defined to transfer heat of the drawer heater 130 to the inside space S of the drawer 110.

The cover body 210 may include four outer edges, and a border 212 which extends upward from four edges. The border 212 of the cover body 210 may form a preset gap G with respect to the drawer heater 130 (see FIG. 7). By the gap G formed by the border 212 of the cover body 210, the drawer heater 130 may be stably covered.

The drawer heater cover 200 may include an incision 214 (e.g., a recess) formed by removing a portion of the cover body 210 from a rear portion of the cover body 210. The incision 214 may be formed to correspond to the heater installing portion 127 of the drawer casing 120. The incision 214 may be formed to correspond to the drawer heater bracket 131 of the drawer heater 130. The incision 214 may be formed by cutting at least one of the cover body 210 such that the drawer heater bracket 131 is not caught by or does not interfere with the cover body 210. The incision 214 may be formed such that the drawer heater bracket 131 moves without interference upon assembling or separating of the drawer heater 130 from other components of the drawer device 100. The incision 214 may prevent the drawer heater bracket 131 from interfering with the cover body 210 upon separating or installing of the drawer heater 130.

The drawer heater cover 200 may include a first coupler 230 and a second coupler 220. The first coupler 230 and the second coupler 220 may couple the drawer heater cover 200 with the drawer casing 120. That is, the drawer heater cover 200 may be coupled with the drawer casing 120 by (or at) the first coupler 230 and the second coupler 220.

The drawer heater cover 200 may include the first coupler 230 rotatably coupled with the drawer casing 120. The drawer heater cover 200 may include the second coupler 220 to which an access is possible through the opening 121 of the drawer casing 120 and which is detachably coupled with the drawer casing 120.

The first coupler 230 may be positioned at a rear lower portion of the drawer heater cover 200. The first coupler 230 may rotatably couple the drawer heater cover 200 with the drawer casing 120.

The first coupler 230 may include a first bracket 231 and a first coupling member 233.

The first bracket 231 may be formed at a lower portion of the drawer heater cover 200. The first bracket 231 may be formed at both edges of the cover body 210. The first bracket 231 may be formed at both edges of the cover body 210 such that at least one portion of the first bracket 231 protrudes downward. The first bracket 231 may be formed by protruding at least one of a lower end or a lower surface of the cover body 210 downward.

In the first bracket 231, a first coupling hole 232 may be formed. The first coupling member 233 may pass through the first coupling hole 232 and be coupled with the drawer casing 120.

In the drawer casing 120, a hinge hole 234 (e.g., a first coupling member) with which the first coupling member 233 of the first coupler 230 is coupled, may be formed. The hinge hole 234 may be formed in the side panels 123 of the drawer casing 120. The hinge hole 234 may be positioned in rear portions of the side panels 123 of the drawer casing 120. The hinge hole 234 may be positioned in upper areas of the rear portions of the side panels 123 of the drawer casing 120.

The second coupler 220 of the drawer heater cover 200 may be positioned adjacent to the opening 121 of the drawer casing 120 such that an access to the second coupler 220 is possible through the opening 121 of the drawer casing 120. The second coupler 220 may be positioned in a front portion of the drawer heater cover 200.

The second coupler 220 may be positioned in a front, lower portion of the drawer heater cover 200. The second coupler 220 may detachably couple the drawer heater cover 200 with the drawer casing 120. The second coupler 220 may include a second bracket 221 and a second coupling member 223.

The second bracket 221 may be formed in the lower portion of the drawer heater cover 200. The second bracket 221 may be formed at both edges of the cover body 210. The second bracket 221 may be formed by protruding at least one portions of the both edges of the cover body 210 downward. In the second bracket 221, a second coupling hole 222 may be formed. The second coupling member 223 may pass through the second coupling hole 222 of the second bracket 221 and be coupled with the drawer casing 120.

In the drawer casing 120, a coupling groove 224 (e.g., a second coupling member) with which the second coupling member 223 of the second coupler 220 is coupled may be formed. The coupling groove 224 may be formed in the side panels 123 of the drawer casing 120. The coupling groove 224 may be positioned in front portions of the side panels 123 of the drawer casing 120. The coupling groove 224 may be positioned in upper areas of the front portions of the side panels 123 of the drawer casing 120.

The second coupling member 223 may include a screw. By coupling the second coupling member 223 with the second coupler 220 of the drawer heater cover 200, that is, the second coupling hole 222 and the coupling groove 224 of the drawer casing 120, the drawer heater cover 200 may be removably fixed to the drawer casing 120.

Figure 6:
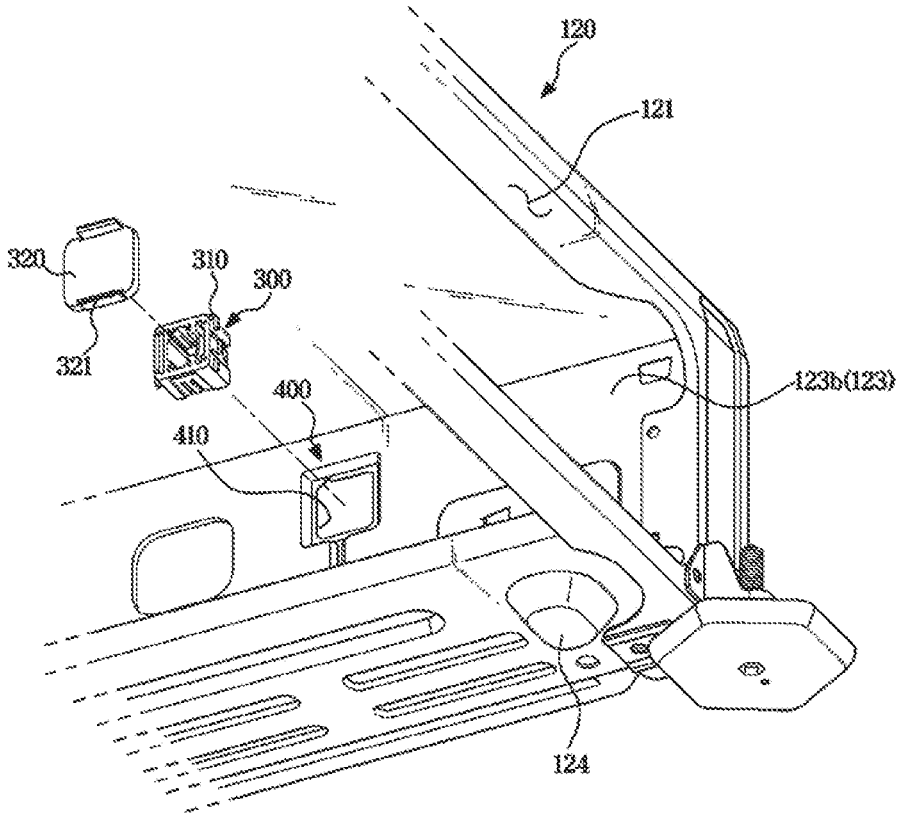
FIG. 6 shows a terminal relative to a drawer casing according to an embodiment of the disclosure.

FIG. 6 shows a terminal 300 installed in a drawer casing 120 according to an embodiment of the disclosure.

As shown in FIG. 6, a terminal 300 for product installation and services such as software update may be installed in the oven 1. The terminal 300 may include a communication protocol terminal without being limited thereto.

The terminal 300 may further include a terminal cover 320. The terminal cover 320 may protect the terminal 300. The terminal cover 320 may cover an outer side of the terminal 300. The terminal cover 320 may be larger than the terminal 300 to cover the terminal 300. In the terminal cover 320, a handle which a user can grip may be provided. The terminal cover 320 may be coupled with a terminal installing portion 400 of the drawer casing 120. The terminal installing portion 400 will be described below.

The drawer device 100 may include the terminal installing portion 400 in which the terminal 300 is installed. The terminal installing portion 400 may be provided in a front portion of the drawer casing 120 such that an access to the terminal installing portion 400 is possible through the opening 121 of the drawer casing 120.

The terminal installing portion 400 may be provided by forming at least one portion of the drawer casing 120. By forming at least one portion of the side panels 123 of the drawer casing 120 inwardly, the terminal installing portion 400 may be provided. By depressing at least one portion of the side panels 123 of the drawer casing 120, the terminal installing portion 400 may be formed. In an embodiment, the drawer casing 120 may include a top panel 122 adjacent to the first heating space (e.g., the cooking room 11), one or more of a side panel 123 extended from an edge of the top panel 122 and in direction away from the first heating space, and the side panel defining a depression corresponding to the front of the oven 1 to define the terminal installing portion 400. The terminal installing portion 400 may be provided in the second side 123*b* being the right one among the side panels 123 of the drawer casing 120. The terminal installing portion 400 may be formed by depressing at least one portion of the second side 123*b* toward the inside of the drawer casing 120.

The terminal 300 installed in the terminal installing portion 400 may be connected to a cable (not shown). The cable connected to the terminal 300 may be connected to a Printed Board Assembly (PBA) provided in the main body 10 of the oven 1.

According to an embodiment of the disclosure, an example in which the terminal installing portion 400 is positioned to the right side of the drawer casing 120 to arrange various cables installed in the oven 1 toward the PBA is shown, however, a concept of the disclosure is not limited thereto. For example, the terminal installing portion 400 may change according to a product configuration or design convenience. The terminal 300 may be fitted into and coupled with the terminal installing portion 400. The terminal 300 may be inserted into and coupled with the terminal installing portion 400. On an outer circumference of the terminal 300, a terminal fixing portion 310 may be provided to be fitted into and coupled with the terminal installing portion 400 and thus fixed to the terminal installing portion 400. The terminal fixing portion 310 may enable the terminal 300 to be inserted into and fixed to the terminal installing portion 400.

The terminal installing portion 400 may be positioned at an upper location relative to the rail device 50 of the drawer casing 120 (see FIG. 7). The terminal installing portion 400 may be positioned at an upper location relative to the second rail 52 of the drawer casing 120. The terminal installing portion 400 may include a terminal installing hole 410 through which the terminal 300 passes. The terminal 300 may pass through the terminal installing hole 410 and be coupled with the terminal installing hole 410. The terminal 300 may be fitted into and coupled with the terminal installing hole 410.

The terminal installing hole 410 in which the terminal 300 is installed may be positioned in the front portion of the drawer casing 120 such that an access to the terminal installing hole 410 is possible through the opening 121 of the drawer casing 120. The terminal installing hole 410 may be positioned close to the opening 121 of the drawer casing 120 such that an access to the terminal installing hole 410 is possible through the opening 121 of the drawer casing 120.

Accordingly, a user who tries to use the terminal 300 for a software-related task, etc. may withdraw only the drawer 110 of the drawer device 100 and then access the terminal 300 through the opening 121 of the drawer casing 120 which is exposed by the withdrawn door 110, thereby performing a task without having to move the oven 1.

Since the terminal 300 can be used without having to move the overall the oven 1 to provide access to the terminal 300, a task may be stably performed without applying any damage to a surrounding installation environment or product, resulting in an improvement of workability.

Figure 8:
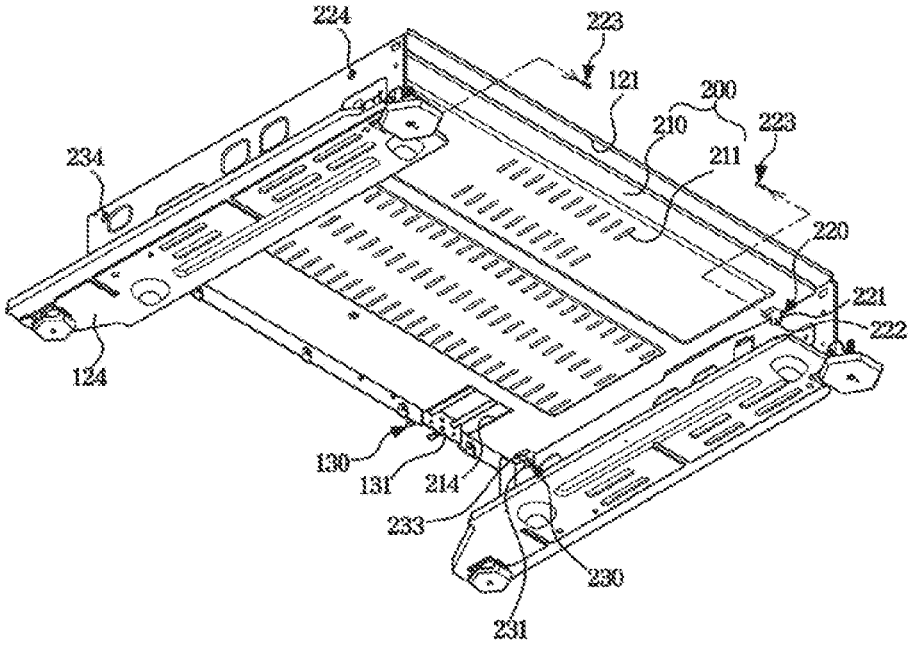
FIG. 8 shows a drawer heater cover installed in a drawer casing according to an embodiment of the disclosure.

FIG. 7 is a side sectional view of a drawer device 100 according to an embodiment of the disclosure, showing a drawer heater cover 200 installed in a drawer casing 120, and FIG. 8 shows a drawer heater cover 200 installed in a drawer casing 120 according to an embodiment of the disclosure.

As shown in FIGS. 7 and 8, the drawer heater cover 200 of the drawer device 100 may cover the drawer heater 130.

The drawer heater cover 200 may be provided on an inner upper portion of the drawer casing 120. The drawer heater cover 200 may be provided below the drawer heater 130.

The drawer heater cover 200 may include the second coupler 220 positioned in the front portion of the drawer casing 120, and the first coupler 230 positioned in the rear portion of the drawer casing 120.

An access to the second coupler 220 of the drawer heater cover 200 may be possible through the opening 121 of the drawer casing 120. The second coupler 220 may be positioned close to the opening 121. The second coupler 220 may be detachably coupled with the drawer casing 120.

The first coupler 230 may enable the drawer heater cover 200 to be rotatably coupled with the drawer casing 120.

The first coupler 230 may be positioned at a rear upper portion of the drawer heater cover 200, and the second coupler 220 may be positioned at a front upper portion of the drawer heater cover 200, that is, close to the opening 121 of the drawer casing 120.

The second coupler 220 may detachably fix the drawer heater cover 200 to the drawer casing 120. A user may fix the drawer heater cover 200 to the drawer casing 120 through the second coupling member 223 of the second coupler 220.

By fixing the second coupling member 223 of the second coupler 220 to the second coupling hole 222 of the drawer casing 120, the drawer heater cover 200 may be fixed to the drawer casing 120.

Along the upper-lower direction (vertical in FIG. 7), the second coupler 220 of the drawer heater cover 200 which is fixed to the drawer casing 120 may locate the drawer heater cover 200 at a first position P1 at which the drawer heater cover 200 covers the drawer heater 130. In the drawer heater cover 200 located at the first position P1, the first coupler 230 and the second coupler 220 may fix the drawer heater cover 200 to the drawer casing 120. That is, the first coupler 230 which is fixed to the drawer casing together with the second coupler 220 fixed to the drawer casing 120, covers the drawer heater 130.

In reverse, by removing the second coupling member 223 of the second coupler 220 from the second coupling hole 222 of the drawer casing 120, the drawer heater cover 200 may be separated from the drawer casing 120.

The drawer heater cover 200 may be located at a second position P2 at which the drawer heater cover 200 exposes the drawer heater 130 (see FIGS. 10 and 11) to outside the drawer heater cover 200. By rotating the drawer heater cover 200 with respect to the first coupler 230 to locate the drawer heater cover 200 slopingly (e.g., inclined) with respect to the first position P1, the drawer heater cover 200 may be located at the second position P2. In the drawer heater cover 200 located at the second position P2, the first coupler 230 may be rotatably coupled with the drawer casing 120, and the second coupler 220 may be separated from the drawer casing 120. That is, the first coupler 230 which is fixed to the drawer casing 120 together with the second coupler 220 detached from the drawer casing 120, allow rotation of the drawer heater cover 200 at a rotation axis corresponding to the hinge holes 234, in a direction away from the top panel 122, and increases a distance between the drawer heater cover 200 and the drawer heater 130. The drawer heater cover 200 which is rotated may defined a maximum distance between the drawer heater cover 200 and the drawer heater 130 at a front of the oven 1 to increase an access room for accessing the drawer heater 130.

Figure 9:
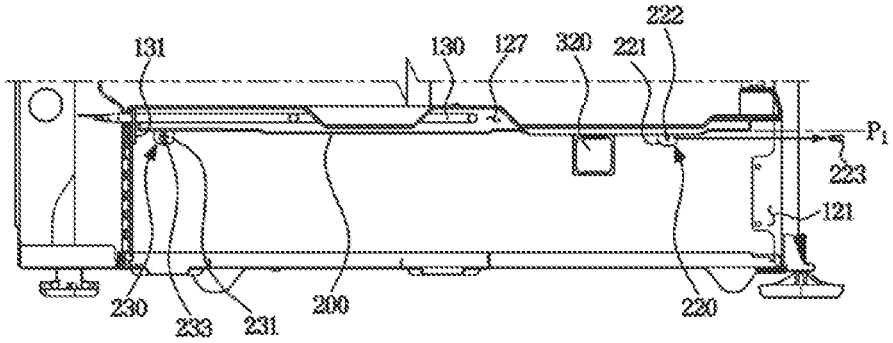
FIGS. 9 to 11 show an operation of a drawer heater cover within a drawer casing according to an embodiment of the disclosure.
Figure 10:
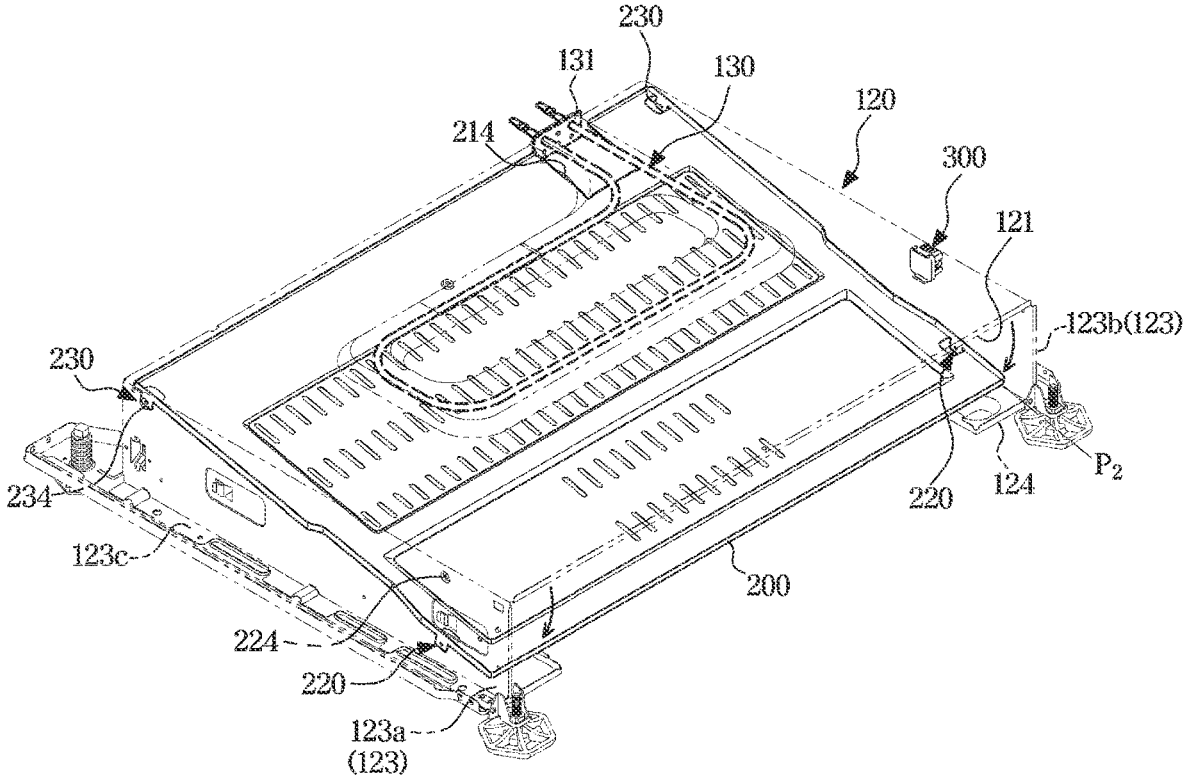
Figure 11:
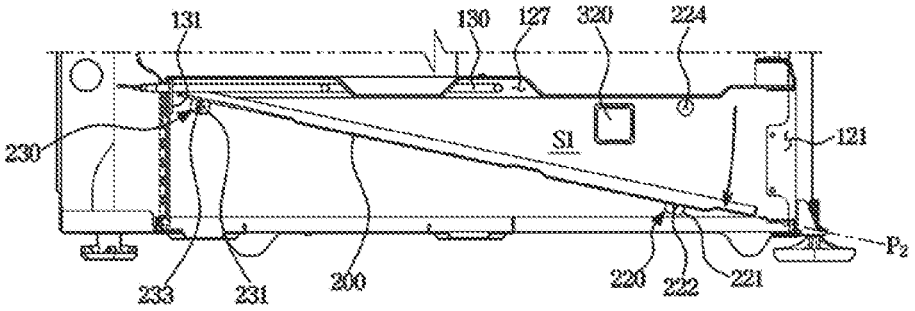
Figure 12:
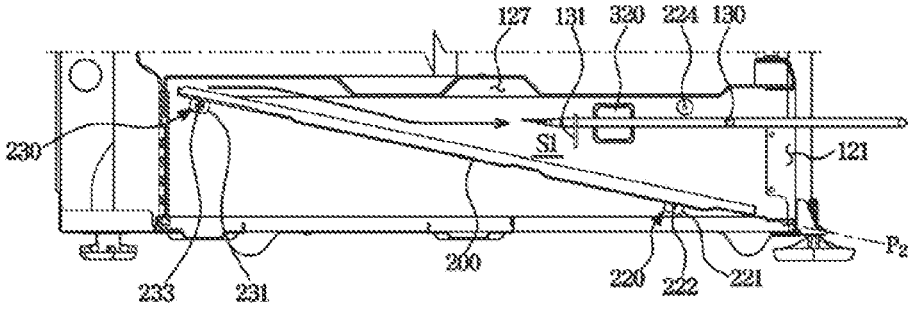
FIG. 12 shows an operation of removing a drawer heater by rotating a drawer heater cover according to an embodiment of the disclosure.

FIGS. 9 to 11 show an operation of a drawer heater cover 200 according to an embodiment of the disclosure, and FIG. 12 shows an operation of removing a drawer heater 130 by rotating a drawer heater cover 200 according to an embodiment of the disclosure.

As shown in FIGS. 9 to 12, the drawer heater cover 200 installed in the drawer casing 120 of the drawer device 100 may protect the drawer heater 130. That is, the drawer heater cover 200 which is unrotated, covers the drawer heater 130 (see FIG. 9).

To separate the drawer heater 130 for a repair or replacement, a user may remove the second coupling member 223 of the drawer heater cover 200 through the opening 121 of the drawer casing 120 (see FIG. 9).

All of second coupling members 223 fixed at both edges of the drawer heater cover 200 may be removed. That is, the drawer heater cover 200 which is coupled with the drawer casing 120 at the front of the oven 1, together with the drawer heater cover 200 coupled to the drawer casing 120 at the rear of the oven 1, disposes the drawer heater cover 200 unrotated. According to an embodiment of the disclosure, an example in which the couplers for detachably fixing the drawer heater cover 200 with the drawer casing 120 are respectively formed at the left and right edges of the drawer heater cover 200 is shown, however, a concept of the disclosure is not limited thereto. For example, the couplers may be located without any limitation in number at various positions where an access to the couplers is possible through the opening 121 of the drawer casing 120.

After the second coupling member 223 positioned between the drawer casing 120 and the drawer heater cover 200 is removed, the drawer heater cover 200 may rotate at the first coupler 230.

By rotating the drawer heater cover 200 about a rotation axis corresponding to the first coupler 230 to locate the drawer heater cover 200 slopingly with respect to the first position P1, the drawer heater cover 200 may be located at the second position P2. In a case in which the drawer heater cover 200 is at the second position P2, the drawer heater cover 200 may be separated from the drawer casing 120 and move downward (refer to FIGS. 10 and 11). That is, the drawer heater cover 200 which is detached from the drawer casing 120 at the front of the oven 1, together with the drawer heater cover 200 coupled to the drawer casing 120 at the rear of the oven 1, disposes the drawer heater cover 200 rotated. Also, the drawer heater cover 200 which is rotated, exposes the drawer heater 130 to outside the drawer heater cover 200. The drawer heater cover 200 may have a shape so as to not interfere with the terminal 300 which is installed in the terminal installing portion 400 in moving from the first position P1 to the second position P2.

By rotating the drawer heater cover 200 at the first coupler 230, the front portion in which the second coupler 220 is positioned may move downward. The drawer heater cover 200 may rotate at the first coupler 230 by its own weight. By rotating the drawer heater cover 200, a removal space 51 may be formed between the drawer casing 120 and the drawer heater cover 200. The removal space 51 may be formed between an inner upper surface of the drawer casing 120 and the upper surface of the drawer heater cover 200. The removal space 51 may enable the drawer heater 130 to move forward and be removed. Through the removal space 51, a user may move the drawer heater 130 forward and remove or replace the drawer heater 130 (refer to FIG. 12). The drawer heater 130 may be exposed to outside the oven 1, via the removal space 51 and the opening 121.

For a task, such as use of the terminal 300 of the oven 1 or replacement of the drawer heater 130, a user may separate and replace the drawer heater 130 by removing only the drawer 110 of the drawer device 100, using the terminal 300 through the opening 121 of the drawer casing 120, or accessing the second coupler 220 of the drawer heater cover 200 through the opening 121 of the drawer casing 120, resulting in an improvement of task performance.

Figure 13:
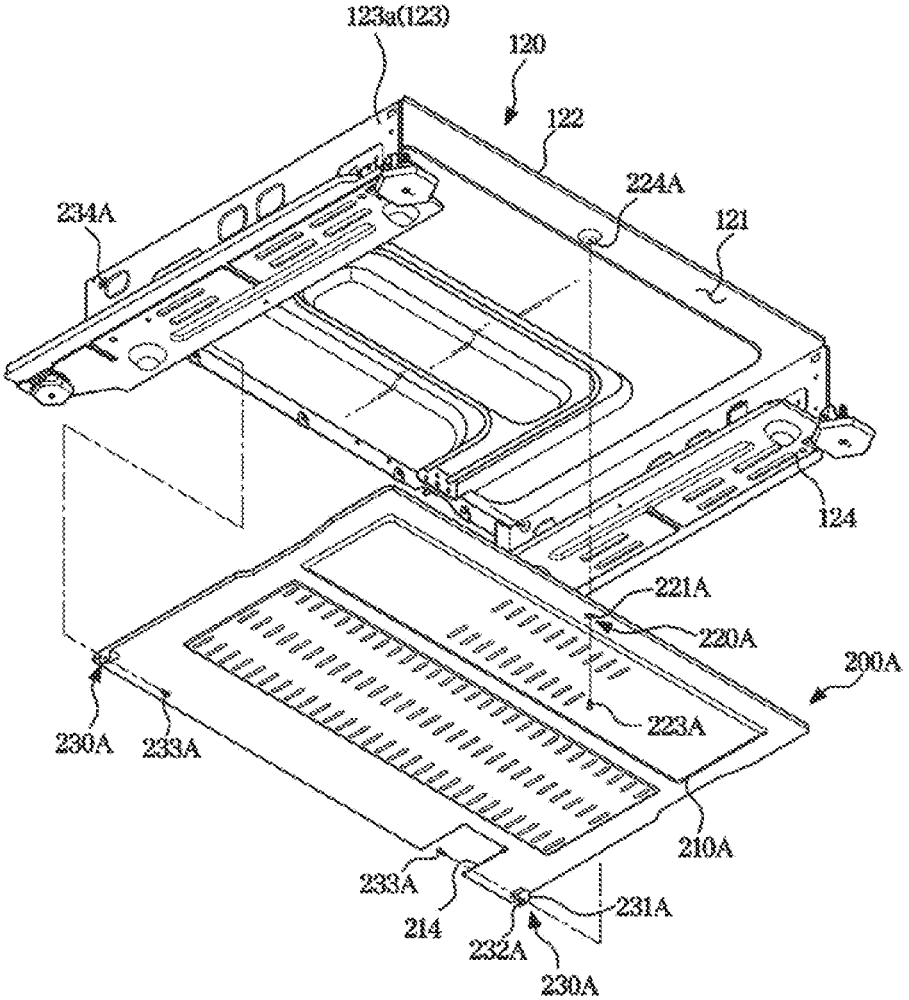
FIG. 13 is a perspective view of a drawer heater cover according to an embodiment of the disclosure.
Figure 14:
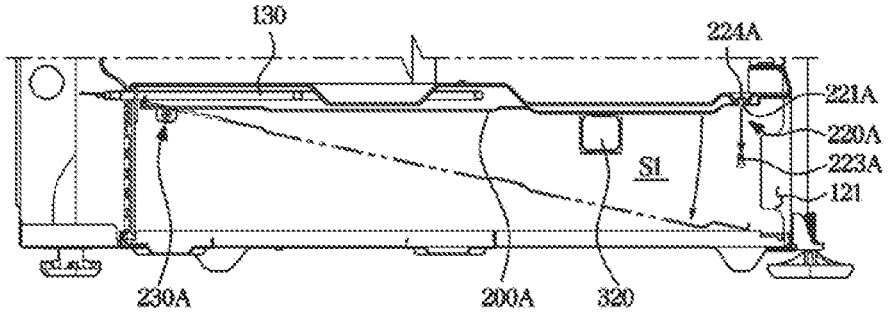
FIG. 14 is a cross-sectional view of FIG. 13, showing an operation of the drawer heater cover according to the embodiment of the disclosure.

FIG. 13 is a perspective view of a drawer heater cover 200A according to an embodiment of the disclosure, and FIG. 14 is a cross-sectional view of FIG. 13, showing an operation of the drawer heater cover 200A according to the embodiment of the disclosure. Reference numbers not shown are referred to in FIGS. 1 to 12.

As shown in FIGS. 13 and 14, a drawer heater cover 200A may include a second coupler 220A.

The second coupler 220A may be positioned in a front portion of the drawer heater cover 200A.

An access to the second coupler 220A may be possible through the opening 121 of the drawer casing 120. The second coupler 220A may be positioned close to the opening 121. The second coupler 220A may detachably couple the drawer heater cover 200A with the drawer casing 120.

The second coupler 220A may include a second coupling hole 221A and a second coupling member 223A formed in a cover body 210A of the drawer heater cover 200A.

The second coupling hole 221A may be formed at a front center of the drawer heater cover 200A. The second coupling hole 221A may be formed at a front center of the cover body 210A.

In the drawer casing 120, a coupling groove 224A (e.g., coupling protruded portion) with which the second coupling member 223A of the second coupler 220A is coupled may be formed. The coupling groove 224A may be formed at a location corresponding to the second coupling hole 221A.

The coupling groove 224A may be formed in the top panel 122 of the drawer casing 120. The coupling groove 224A may be positioned in a front portion of the top panel 122 of the drawer casing 120. The coupling groove 224A may be positioned close to the opening 121 of the drawer casing 120.

The second coupling member 223A may include a screw. By coupling the second coupling member 223A with the coupling groove 224A of the drawer casing 120 through the second coupling hole 221A of the drawer heater cover 200A, the drawer heater cover 200A may be fixed to the drawer casing 120.

In this case, a first coupler 230A of the drawer heater cover 200A may enable the drawer heater cover 200A to be rotatably coupled with the drawer casing 120.

The first coupler 230A may be positioned at a rear portion of the drawer heater cover 200. The first coupler 230A may rotatably couple the drawer heater cover 200A with the drawer casing 120.

The first coupler 230A may include a first bracket 231A and a first coupling member 233A.

The first bracket 231A may be formed in a rear lower portion of the drawer heater cover 200A. The first bracket 231A may be formed at both edges of the cover body 210A. The first bracket 231A may be formed by protruding at least one portions of both edges of the cover body 210A downward. A first coupling hole 232A may be formed in the first bracket 231A.

The first coupling member 233A may pass through the first coupling hole 232A to be coupled with the first coupling hole 232A.

In the drawer casing 120, a hinge hole 234A with which the first coupling member 233A of the first coupler 230A is coupled may be formed. The hinge hole 234A may be formed in the side panels 123 of the drawer casing 120.

The hinge hole 234A may be positioned in rear upper portions of the side panels 123 of the drawer casing 120.

Accordingly, the first coupler 230A corresponding to a rear end of the drawer heater cover 200A may be rotatably coupled with the drawer casing 120, and the second coupler 220A corresponding to a front end of the drawer heater cover 200A may be detachably coupled with the drawer casing 120.

By fixing the second coupling member 223A of the second coupler 220A with the coupling groove 224 of the drawer casing 120, the drawer heater cover 200A may be fixed to the drawer casing 120.

In reverse, by removing the second coupling member 223A of the second coupler 220A from the coupling groove 224 of the drawer casing 120, the drawer heater cover 200A may be separated from the drawer casing 120A and rotate downward (refer to FIG. 14). Accordingly, the drawer heater 130 may be exposed to outside the drawer casing 120A through a space between the drawer heater cover 200A and the drawer casing 120A.

Details about the configuration and operation of the drawer device 100 including the above-described configuration have been described in the above-described embodiments, and therefore, overlapping descriptions will be omitted.

Figure 15:
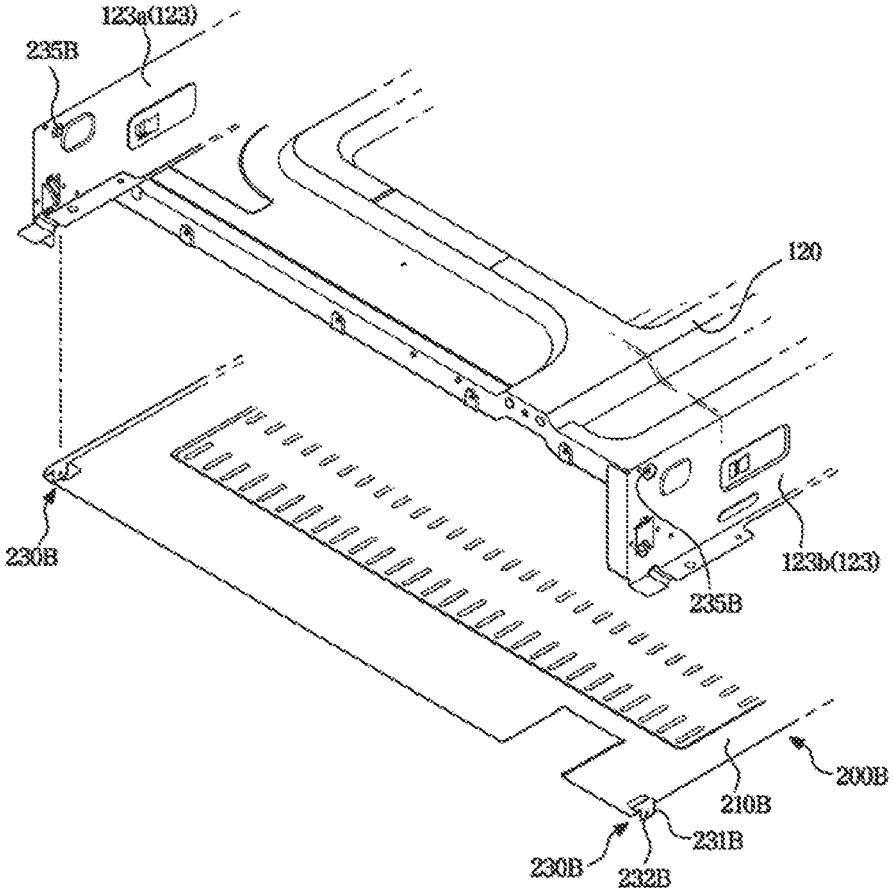
FIGS. 15 and 16 show a drawer heater cover according to an embodiment of the disclosure.
Figure 16:
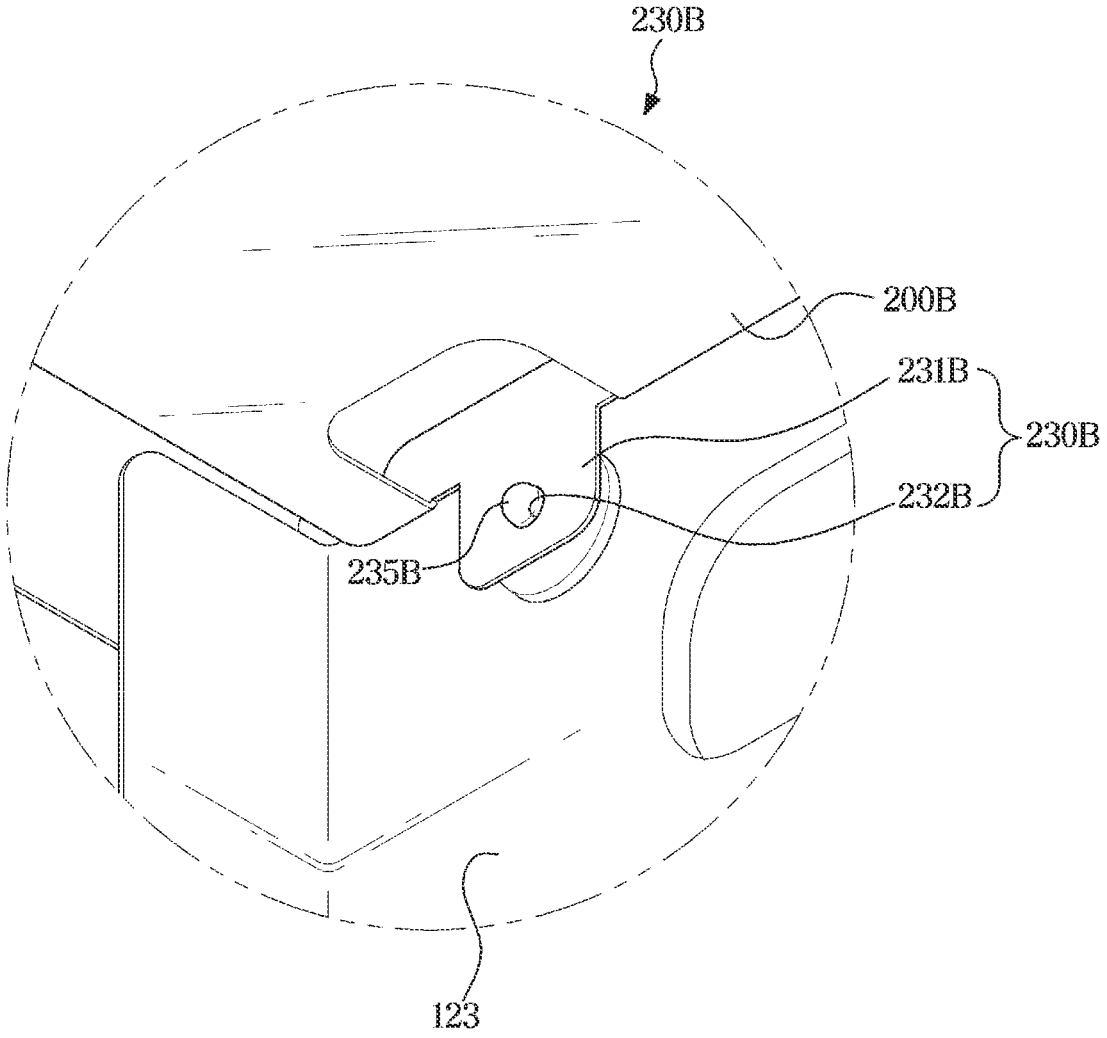

FIGS. 15 and 16 show a drawer heater cover 200 according to an embodiment of the disclosure. Reference numbers not shown are referred to in FIGS. 1 to 12.

FIGS. 15 and 16 show a drawer heater cover 200B according to an embodiment of the disclosure.

In a drawer heater cover 200B, a first coupler 230B may be provided. The first coupler 230B may be positioned in a rear portion of the drawer heater cover 200B. The first coupler 230B may rotatably couple the drawer heater cover 200B with the drawer casing 120.

The first coupler 230B may include a first bracket 231B. A first coupling hole 232B may be formed in the first bracket 231B.

The first bracket 231B may be formed at a lower portion of the drawer heater cover 200B. The first bracket 231B may be formed at both edges of the rear portion of the cover body 210. The first bracket 231B may be formed by protruding at least one portions of both edges of the cover body 210B downward.

The first coupling hole 232B may be coupled with a coupling protrusion 235B of the drawer casing 120.

In the drawer casing 120, a coupling protrusion 235B which is rotatably coupled with the first coupling hole 232B of the first coupler 230B may be formed. The coupling protrusion 235B may be formed in (or by) the side panels 123 of the drawer casing 120. The coupling protrusion 235B may be formed in the first side 123*a* and the second side 123*b*. The coupling protrusion 235B may be a protruded portion of the side panels 123.

The coupling protrusion 235B may be positioned in a rear portion of each of the side panels 123*a* and 123*b* of the drawer casing 120. The coupling protrusion 235B may be positioned in a rear upper portion of each of the side panels 123*a* and 123*b* of the drawer casing 120.

The second coupler 220 of the drawer heater cover 200 may be positioned close to the opening 121 of the drawer casing 120 such that an access to the second coupler 220 is possible through the opening 121 of the drawer casing 120. The second coupler 220 may be positioned in the front portion of the drawer heater cover 200.

Accordingly, by fitting the first coupling hole 232B of the first coupler 230B with the coupling protrusion 235B of the drawer casing 120 and coupling the first coupling hole 232B with the coupling protrusion 235B, the drawer heater cover 200B may be rotatably coupled with the drawer casing 120, and detachably coupled with the drawer casing 120 through the second coupler 220.

Details about the configuration and operation of the drawer device 100 including the above-described configuration have been described in the above-described embodiments, and therefore, overlapping descriptions will be omitted.

So far, although the technical concept of the disclosure has been described based on specific embodiments, the scope of rights of the disclosure is not limited to these embodiments. It should be interpreted that various embodiments modified or changed by a person skilled in the art within a scope not deviating from the gist of the disclosure as the technical concept of the disclosure, which is defined in the claims, also belong to the scope of rights of the disclosure.

The present disclosure may improve installation and service efficiency by improving a heater cover structure of a drawer device 100.

Also, since a heater member can be replaced in a front direction without completely separating a heater cover from the appliance, workability may be improved upon the repair or replacement of the heater member.

Also, since a software-related task can be performed in the front direction without having to move the appliance which is a relatively heavy product by improving an installation location of a terminal provided in the drawer device 100, no damage may be applied to a surrounding installation environment and it may be unnecessary to move the product, resulting in securing an engineer's stability.

Also, any additional task such as product reinstallation may be not needed, which leads to an improvement of workability.

What is claimed is:

1. An oven including:

a main body providing a first heating space of the oven, and a drawer device which is below the first heating space, and a heater below the first heating space and providing heat to the first heating space, wherein the drawer device comprises:

a drawer casing providing an opening at which the drawer casing is open to outside the drawer device at a front of the oven;

a drawer insertable into or removable out of the drawer casing, through the opening;

a drawer heater installed in the drawer casing; and a drawer heater cover detachably coupled with the drawer casing at the front of the oven and rotatably coupled with the drawer casing at a rear of the oven which is opposite to the front of the oven, the drawer heater cover being moveable relative to the drawer heater, wherein the drawer which is inserted into the drawer casing defines a second heating space of the oven, together with the drawer casing, and the drawer heater cover, when unrotated, covers the drawer heater and dissipates heat from the first heating space.

2. The oven of claim 1, wherein the drawer heater cover, when unrotated, covers the drawer heater, and the drawer heater cover, when rotated, exposes the drawer heater to outside the drawer heater cover.

3. The oven of claim 2, wherein the drawer heater cover which is coupled with the drawer casing at the front of the oven, together with the drawer heater cover coupled to the drawer casing at the rear of the oven, disposes the drawer heater cover unrotated.

4. The oven of claim 3, wherein the drawer heater cover which is detached from the drawer casing at the front of the oven, together with the drawer heater cover coupled to the drawer casing at the rear of the oven, disposes the drawer heater cover rotated.

5. The oven of claim 1, wherein the drawer heater cover defines a hole through which heat provided from the drawer heater is transferred to the second heating space of the oven.

6. The oven of claim 1, further comprising a communication protocol terminal installed in the drawer casing at a terminal installing portion of the drawer casing, the terminal installing portion corresponding to the front of the oven, wherein the terminal installing portion is accessible from outside the oven through the opening of the drawer casing.

7. The oven of claim 6, wherein the drawer casing comprises:

a top panel adjacent to the first heating space, a side panel extended from an edge of the top panel and in a direction away from the first heating space, and the side panel being depressed at the front of the oven to define the terminal installing portion.

8. The oven of claim 7, wherein the drawer casing further comprises a rail along which the drawer is movable, and the terminal installing portion is above the rail.

9. A drawer device for a heating appliance, comprising:

a drawer casing providing an opening at which the drawer casing is open to outside the drawer device at a front of the heating appliance;

the drawer casing comprising:

a top panel adjacent to the first heating space, and a side panel which extends from the top panel and defines the opening together with the top panel;

a drawer insertable into or removable out of the drawer casing, through the opening;

a drawer heater installed in the drawer casing; and a drawer heater cover detachably coupled with the drawer casing at the front of the heating appliance and rotatably coupled to the side panel at a rear of the heating appliance which is opposite to the front of the heating appliance, the drawer heater cover being moveable relative to the drawer heater.

10. The drawer device of claim 9, wherein the drawer heater cover, when unrotated, covers the drawer heater, and the drawer heater cover, when rotated, exposes the drawer heater to outside the drawer heater cover.

11. The drawer device of claim 10, wherein the drawer heater cover which is coupled with the drawer casing at the front of the heating appliance, together with the drawer heater cover coupled to the drawer casing at the rear of the heating appliance, disposes the drawer heater cover unrotated.

12. The drawer device of claim 10, wherein the drawer heater cover which is detached from the drawer casing at the front of the heating appliance, together with the drawer heater cover coupled to the drawer casing at the rear of the heating appliance, disposes the drawer heater cover rotated.

13. The drawer device of claim 10, wherein the drawer which is inserted into the drawer casing defines a second heating space of the heating appliance, together with the drawer casing, the drawer heater cover, when unrotated, covers the drawer heater, and the drawer heater cover defines a hole through which heat provided from the drawer heater is transferred to the second heating space of the heating appliance.

* * * * *